United States Patent [19]

Schneckenburger

[11] Patent Number: 4,649,839

[45] Date of Patent: Mar. 17, 1987

[54] SEWING MACHINE TAPE BRAKING DEVICE

[75] Inventor: Günter Schneckenburger, Zapfendorf, Fed. Rep. of Germany

[73] Assignee: Pfaff Industriemaschinen GmbH, Fed. Rep. of Germany

[21] Appl. No.: 811,650

[22] Filed: Dec. 20, 1985

[30] Foreign Application Priority Data

Dec. 20, 1984 [DE] Fed. Rep. of Germany ... 8437323[U]

[51] Int. Cl.[4] ..... D05B 21/00; D05B 35/06

[52] U.S. Cl. ..... 112/121.26; 112/152; 112/305; 242/83

[58] Field of Search ..... 112/121.26, 121.27, 112/130, 152, 148, 150, 305; 242/83

[56] References Cited

U.S. PATENT DOCUMENTS

| | | | |
|---|---|---|---|
| 1,277,008 | 8/1918 | Weis | 112/152 |
| 1,495,424 | 5/1924 | Morgan | 112/130 |
| 2,070,200 | 2/1937 | Ernst | 112/130 |
| 2,150,677 | 3/1939 | Ernst | 112/130 |
| 4,421,044 | 12/1983 | Freermann et al. | 112/148 X |

*Primary Examiner*—H. Hampton Hunter

*Attorney, Agent, or Firm*—McGlew and Tuttle

[57] ABSTRACT

A braking device for strip material particularly for a sewing machine which sews a garment requiring ruffling comprises a fixed guide over which the strip material such as tape is fed. A resilient member overlies the fixed guide and it is engaged by a multi-step cam plate mounted for rotation about an axis so that a plurality of flat sides thereof may be selectively engaged against the resilient member to force it against the material passing on the guide so as to apply a selected braking force thereto. The resilient member advantageously comprises a leaf spring and the multi-step cam plate includes a plurality of engagements surfaces arranged at different distances from the central axis of its rotation which may be positioned by a hand knob control to bear against the resilient member and effect the varying braking of the tape being fed. The sewing machine advantageously is provided with a table having a slot through which the tape is fed onto the material being sewn and the sewing machine feeding device advances the tape off its reel supply and the braking of the tape to slow its feed is used for example, to effect the sewing of ruffles or similar arrangements on the material being fed as it is joined to the tape.

9 Claims, 3 Drawing Figures

SEWING MACHINE TAPE BRAKING DEVICE

FIELD AND BACKGROUND OF THE INVENTION

This invention relates in general to sewing machines and in particular to a new and useful braking device for regulating the feed of a tape into the sewing machine which is operating on a garment to sew the tape thereon.

In a known brake device, as disclosed in U.S. Pat. No. 1,277,008 an elastic tape, coming from a supply roll disposed below the sewing table plane, is supplied traversing between the fixed guide member and the brake shoe to a deflecting guide arranged before the stitch formation point of the sewing machine between the folded-over waist edge of a garment such as a skirt. The brake shoe is mounted pivotably at a fixed guide member and is pressed by a spring against the tape abutting the fixed guide member. The brake force to be applied on the tape is adjustable with a set screw, to decelerate the tape at a controlled rate relative to the folded-over cloth plies at which the cloth feeders engage from above and from below, and thereby to retain it in a selected position relative to the folded-over cloth plies, so that the plies are gathered in different degree on certain sections, which, to facilitate handling, are generally marked. For every degree of gathering or ruffling the brake force must be changed. Exact adjustment, however, is not only very time consuming, but it is also almost impossible with known devices of this kind to repeatedly find adjustments exactly enough for different degrees of gathering or ruffling.

SUMMARY OF THE INVENTION

The invention provides a device providing for brake force adjustments for different degrees of gathering or ruffling which can be made quickly and effortlessly and are reproducible with high precision, just as quickly and effortlessly, in any desired alternating sequence.

The braking device of the invention thus designed permits smooth working, whereby a great increase in productivity and a substantial quality improvement are achieved.

Accordingly, it is an object of the invention to provide an improved brake device which includes a fixed guide over which material such as a tape is fed and a resilient member overlying the guide which is engageable with the resilient member to force it by a predetermined amount against the tape.

A further object of the invention is to provide a sewing machine which has a first feeding arrangement for feeding material and a braking device associated therewith for facilitating the feeding of a tape over the material being fed to a needle of the sewing machine by selected braking forces so as to provide distinct sewing results.

A further object of the invention is to provide a braking device and a sewing machine which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
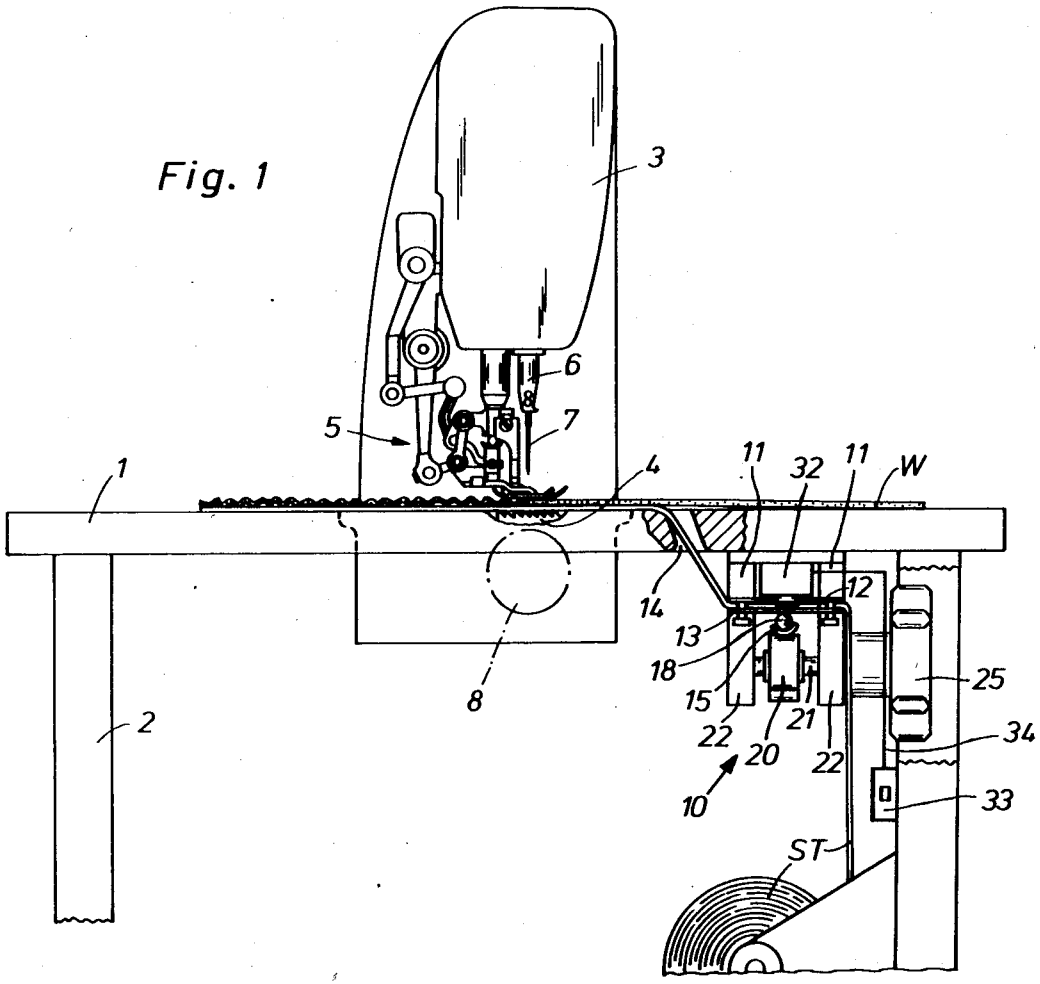
FIG. 1 is an end elevation of a simplified representation of a sewing machine fitted in a frame, with top and bottom transport, with an inventive new brake device constructed in accordance with the invention.
Figure 3:
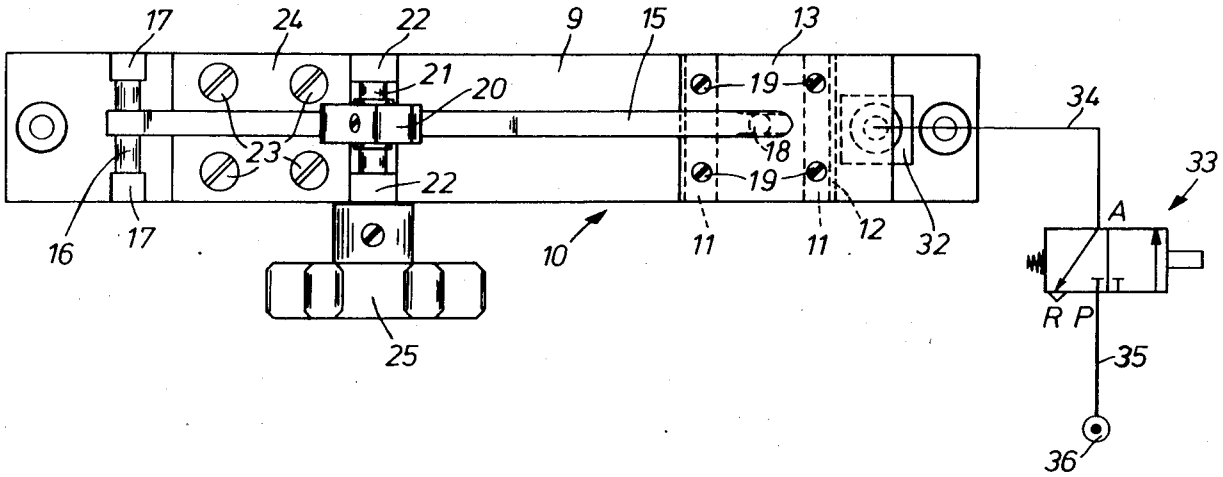
FIG. 3 is a bottom plan view of the brake device from below.
Figure 2:
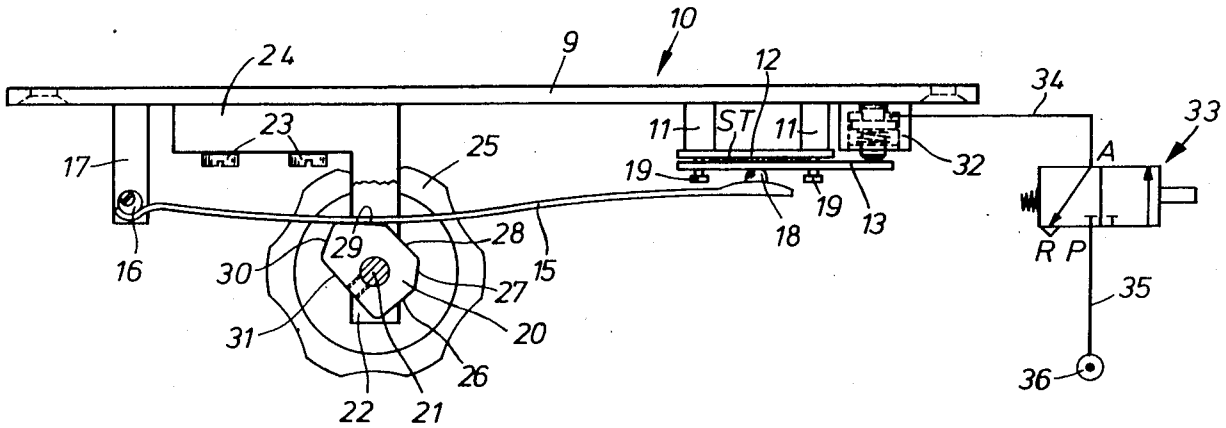
FIG. 2 is a side elevational view with the brake device.

Referring to the drawings in particular the invention embodied therein comprises a braking device generally designated 10 which is used for advancing a tape material ST into association with other material W being fed to the sewing machine over a table 1 using a first sewing machine feeding arrangement or apparatus 5 which feeds the material past a reciprocating needle 7. In accordance with the invention the tape ST is fed over a fixed guide member 12 and up through a slot 14 of the table into association with the material W which is fed to the reciprocating needle 7. In accordance with the invention a resilient member in the form of a leaf spring 15 overlies or underlies the fixed guide member 12 onto which the tape material is fed with means such as a multiple step cam plate 20 positioned in contact with the leaf spring 15 so as to provide a force acting on the spring member 15 which provides a selected braking force to the tape which is being fed. In an opening of a table top 1 of a frame 2, a sewing machine 3 is inserted, which in addition to the usual lower cloth feed 4, executing a rectangular feeding movements, comprises an upper cloth feed system 5. The sliding paths of the lower and upper cloth feeds are adjustable independently of each other. The thread carrying needle 7 of the sewing machine 3, secured on the needle bar 6, cooperates with a shuttle 8 arranged in the cloth support plate of the sewing machine 3, as known, for seam formation.

Screwed to the underside of the table top 1 is a brake device 10, arranged on a support plate 9, for a tape ST to be supplied to the stitch-formation point of the sewing machine 3. The tape ST, coming from a supply roll on the frame 2, is passed between a guide member 12 fastened on spacers 11 at the support plate 9 and a movable brake shoe 13 and through a slanting slot 14 in the table top 1, to the stitch-formation point.

To apply a brake force on the brake shoe 13 there is used in the embodiment a leaf spring 15, one end of which rests on an eccentric stud 16 in bearing brackets 17 of the support plate 9, and whose other end engages at the brake shoe 13 with interposition of a rounded member or rolling body 18. This end of the leaf spring is lightly bent semicircularly and forms a running surface for the rolling body 18. The brake shoe 13 is arranged displaceably on spaced apart shank screws 19 in spacers 11 of the support plate 9 relative to the fixed guide member 12.

To vary the brake force, the tension of the leaf spring 15 is variable by a multi-step cam plate 20, which is mounted on a short shaft 21 in the forked vertical leg 22 of an angle piece 24 secured on the support plate 9 with screws 23. On its free end a turning knob 25 is secured.

On the periphery the cam plate 20 has flat surfaces 26 to 31, which are arranged at different distances from the shaft 21 and form the various steps of the cam plate 20. Each step corresponds to a different brake force value. The basic adjustment is made at the eccentric stud 16. In the operating position, the particular surface 26 to 31 is parallel to its abutment surface on the leaf spring 15. This eliminates the need for an additional locking means to secure the various operating positions of the cam plate 20.

A pneumatic short stroke cylinder 32 attached to the support plate 9 serves to lift the brake shoe 13 off the tape ST or respectively off the fixed guide member 12 counter to the action of the leaf spring 15. The short stroke cylinder 32 can be driven via a 3/2-way valve 33, whose working connection A is connected by a conduit 34 to the short stroke cylinder 32 and is vented via R in the neutral position.

The pump P of the 3/2-way valve 33 is connected via a conduit 35 to a compressed air source 36.

Operation:

The assumption is that a workpiece W needed for example in upholstering, having sections or parts of different degrees of ruffling or gathering and also having sections without gathering, is to be sewn onto the tape ST supplied from below.

Before sewing is started, the upper feed device 5 is lifted and the multiple way valve 33 is actuated, so that compressed air is supplied to the short stroke cylinder 32 from the compressed air source 36 via line 35, connections P and A, and line 34, the working piston of the cylinder 32 raising the brake shoe 13 counter to the action of leaf spring 15. For reintroducing a tape end into the brake device, the brake shoe 13 could also be adapted to be turned aside.

After the brake shoe 13 has been lifted, the tape ST can then be pulled forward unhindered and tension-free to under the raised upper feed device 5, and the multiple way valve 33 can be switched off again. The short stroke cylinder 32 is vented via line 34 and the connections A and P. By a spring in the cylinder housing the working piston of cylinder 32 is moved to its inactive position.

By the leaf spring 15 the brake shoe 13 presses the tape ST against the fixed guide member 12. The magnitude of the brake force to be supplied depends on what degree of gathering or ruffling of the workpiece W on the tape ST likewise inserted under the upper feed device 5 is to have on certain, previously marked sections. This depends on which of the surfaces 26 to 31 disposed at different distance from the axis of rotation 21 applies against the leaf spring 15. Moreover, it is possible to give the upper cloth feed greater forward movements than the lower, to influence the degree of gathering or ruffling.

The adjustment for the following seam section having been selected at the turning knob 25, the upper feed device 5 is lowered and the sewing machine 3 is turned on.

During sewing, the tape ST is held back by the tape brake 10, so that the work W is pushed together by the upper feed device 5, that is, gathered or ruffled, and is fixed in this state on tape ST by a seam. To adjust a different degree of gathering or ruffling, it suffices to turn the multi-step cam plate 20 by means of knob 25, in order that the surface 26 to 31 corresponding to the desired degree of gathering comes to abut on the leaf spring 15. In many cases the sewing machine need not even be stopped. If the work W is to be sewn onto the tape ST without gathering or ruffling, it suffices to actuate the multiple way valve 33 in order to take the brake force away from the brake shoe 13. On the assumption that the upper and lower cloth feed devices 4 and 5 are adjusted for synchronous forward movement, the work W and tape ST are sewn together lying smoothly one on the other.

To mark the operating position of the individual surfaces 26 to 31, markings may be provided on the knob, so that there will be no problem in coming back to the angular position of knob 25 corresponding to a specific degree of gathering on the work W.

While a specific embodiment of the invention has been shown and described in detail to illustrate the application of the principles of the invention, it will be understood that the invention may be embodied otherwise without departing from such principles.

What is claimed is:

1. A brake device for strip material, comprising a fixed guide over which the material is fed, a resilient member in alignment over the material being fed, and adjustable variable force engagement means including a movable member engageable over said resilient member for forcing said resilient member against the material passing on said guide so as to apply a selected braking force thereto, and means for selectively positioning said movable member into one of a plurality of positions to engage material being fed with a selected braking force.

2. A brake device for strip material, comprising a fixed guide over which the material is fed, a resilient member in alignment over the material being fed, and adjustable engagement means engageable with said resilient member for forcing said resilient member against the material passing on said guide so as to apply a selected braking force thereto, said adjustable engagement means comprising a rotatable step cam plate and means mounting said plate for rotation above said resilient member so each step cam can be positioned in contact with said resilient member to bias it by varying amounts against said resilient member so as to achieve the selected braking force thereon.

3. A brake device for strip material, comprising a fixed guide over which the material is fed, a resilient member in alignment over the material being fed, and adjustable engagement means engageable with said resilient member for forcing said resilient member against the material passing on said guide so as to apply a selected braking force thereto, said resilient member comprising a leaf spring, means mounting said leaf spring at one end so that said spring extends outwardly from said one end to overlie said fixed guide, a support member extending between said one end and said fixed guide, a rotatable shaft on said support member, a multi-step cam plate journalled to said shaft being rotatable with said shaft, said cam plate including engagement surfaces at different radii from the center of said shaft engageable on the surface of said leaf spring and deflecting said leaf spring so as to cause it to bias the material fed over said fixed guide by varying amounts.

4. A brake device according to claim 3, wherein said cam plate has steps formed by flat surfaces arranged at different distances from the axis of rotation which surfaces in their operating position extend parallel to the contact surface of said leaf spring.

5. A brake device according to claim 4, wherein said means holding one end of said spring comprises a fixed bearing, the opposite end of said spring having a rolling body thereon engageable over the material fed on said fixed guide.

6. A brake device according to claim 3, including a brake shoe overlying said fixed guide, means guiding said brake shoe for upward and downward movement to permit the material to be positioned between said brake shoe and said fixed guide.

7. A brake device according to claim 6, including means guiding said brake shoe for up and down movement relative to said fixed guide and positioning means engageable with said brake shoe for raising it and lowering it relative to said fixed guide.

8. A brake device according to claim 3, including an adjustable eccentric rotatably supporting said leaf spring.

9. In a sewing machine having a thread needle range for reciprocation into and out of material to be sewn, and means for feeding the material passed the needle for operation thereon by the needle, the improvement comprising, a fixed tape guide over which the tape is passed arranged adjacent the sewing machine, means for guiding the tape to the sewing machine for feeding into association with the material passed the needle from said fixed guide, a brake device including a resilient member over lying said fixed guide, an adjustable means bearing on said resilient member and effective to move said member into one of a plurality of selected positions so as to bear against said resilient member with varied force so as to provide a selected braking force thereto.

* * * * *